United States Patent [19]

Friedman et al.

[11] Patent Number: 4,535,539

[45] Date of Patent: Aug. 20, 1985

[54] FOLDING KNIFE WITH SAFETY LOCKING FEATURE

[75] Inventors: Harry Friedman, Franklin Lakes, N.J.; Isao Sengoku, Seki, Japan; Yukiro Hattori, Seki, Japan; Minoru Isikawa, Seki, Japan

[73] Assignee: Jet AER Corporation, Paterson, N.J.

[21] Appl. No.: 589,159

[22] Filed: Mar. 13, 1984

[51] Int. Cl.[3] ..... B26B 1/04

[52] U.S. Cl. ..... 30/161; 30/159

[58] Field of Search ..... 30/161, 159, 160

[56] References Cited

U.S. PATENT DOCUMENTS

| | | | |
|---|---|---|---|
| 812,601 | 2/1906 | Schrade | 30/159 |
| 821,176 | 5/1906 | Leland | 30/161 X |
| 1,357,398 | 11/1920 | Haywood | 30/161 |
| 1,512,689 | 10/1924 | Herman | 30/161 |
| 1,638,749 | 8/1927 | Santoyo | 30/161 |
| 2,530,236 | 11/1950 | Erickson | 30/159 |
| 2,705,832 | 4/1955 | Mirando | 30/159 |
| 4,240,201 | 12/1980 | Sawby | 30/161 |
| 4,274,200 | 6/1981 | Coder | 30/161 |

*Primary Examiner*—Jimmy C. Peters

*Attorney, Agent, or Firm*—Stiefel, Gross, Kurland & Pavane

[57] ABSTRACT

A foldable knife (10) comprises a handle (14), a blade (12), means (24) for securing the blade (12) to the handle for pivotal movement between a closed position wherein the cutting edge (20) is received in a recess (34) in the handle (14) and an open position wherein the cutting edge edge (20) is exposed, a bar spring (16) secured at one end to the handle (14) in the recess (34), and a mechanism (18) secured in an opening (58), (60) in the handle (14) and extending through a hole (44) in the bar spring (16), the mechanism (18) comprising an enlarged portion (48) and a reduced portion (b 50), and means (54) for moving the mechanism (18) between a locking position when the enlarged portion is in the hole (44) for limiting movement of the bar spring (16) for preventing movement of the blade (12) and a release position wherein the reduced portion (50) is in the hole (44) and sufficient movement of the bar spring (16) is accommodated for moving the blade (12) to the closed or opened positions.

16 Claims, 12 Drawing Figures

FIG. 1
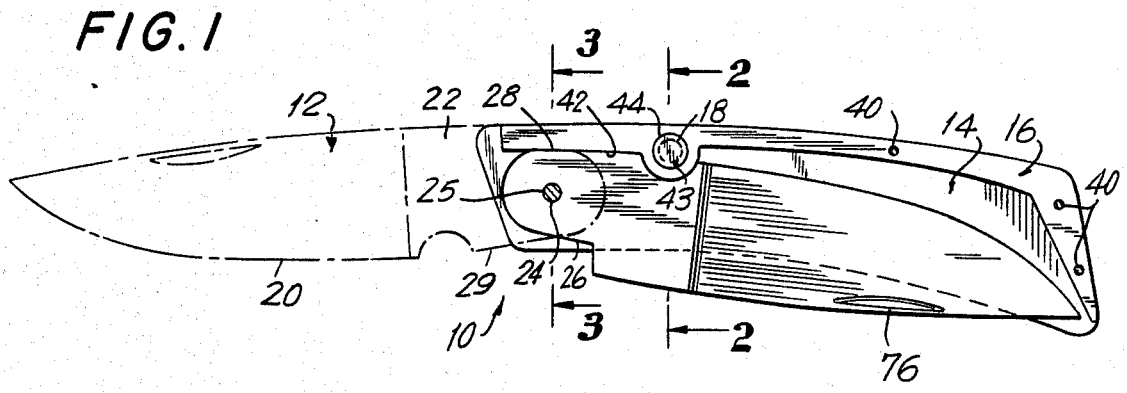
FIG. 2
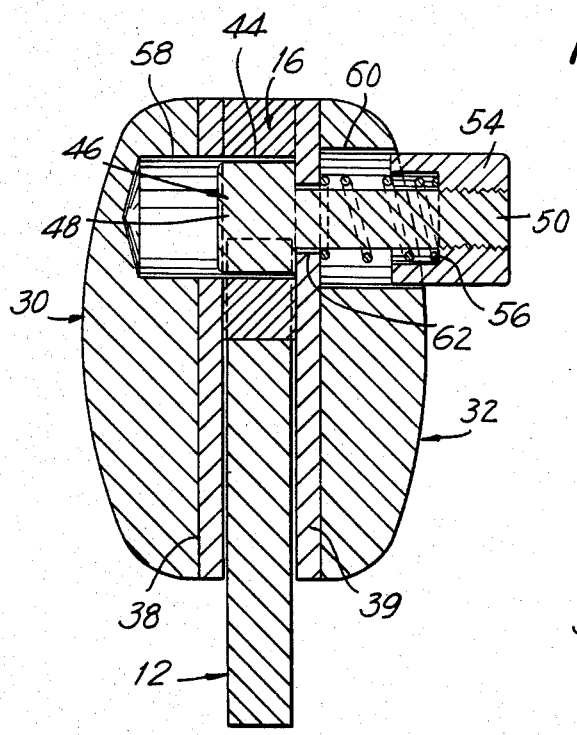
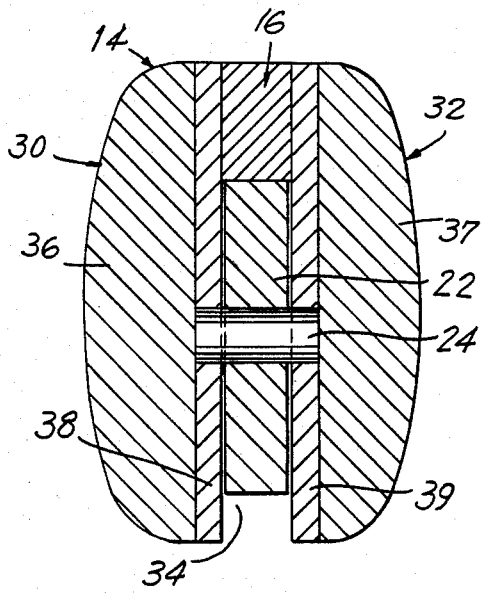
FIG. 3

FIG. 4
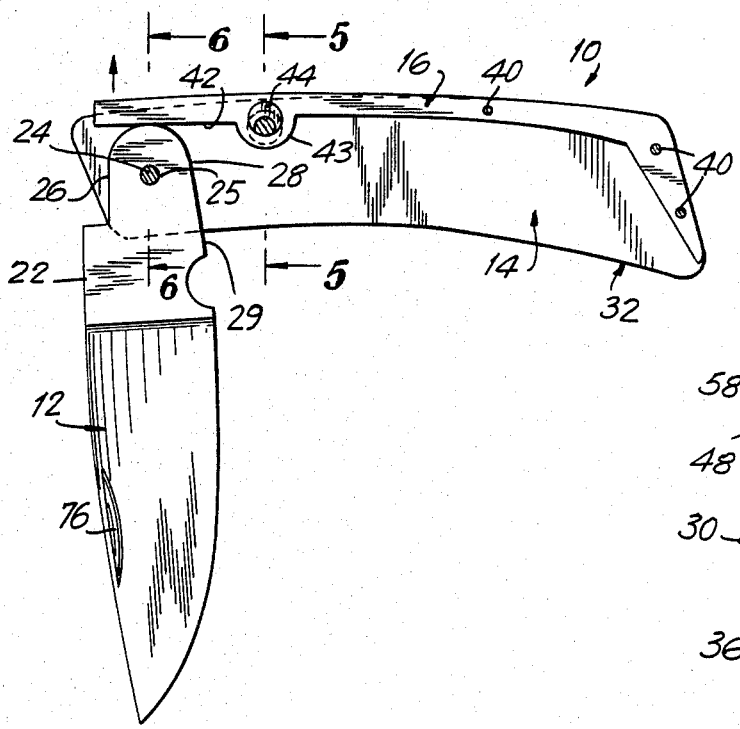
FIG. 5
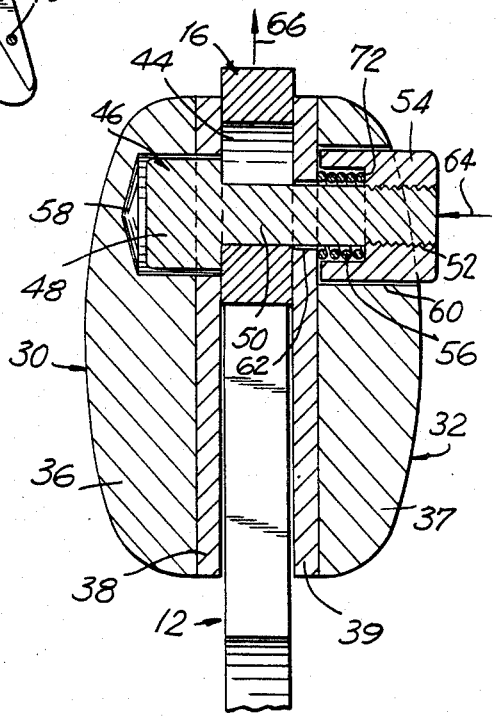
FIG. 6
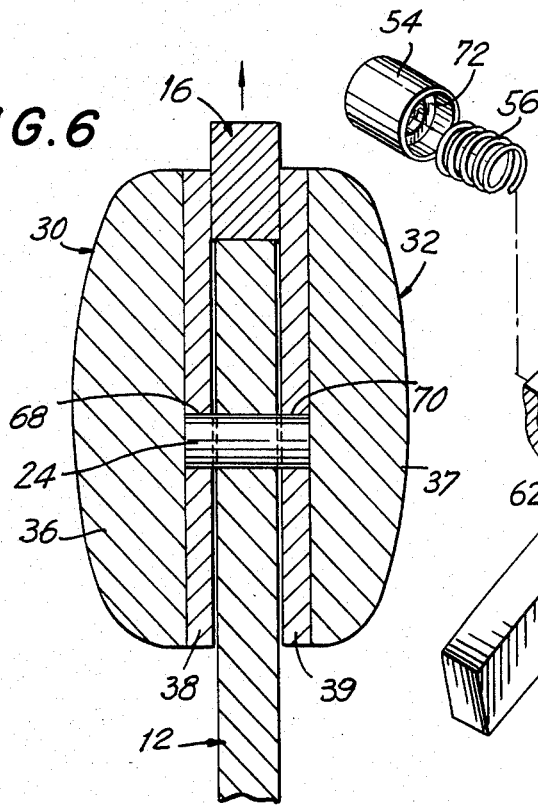
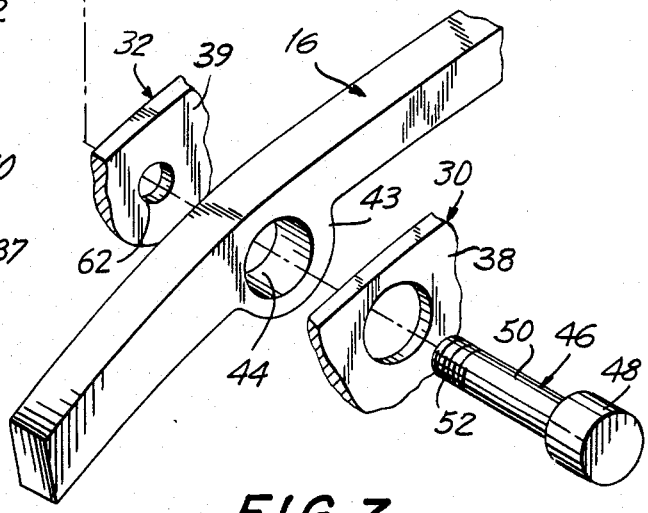
FIG. 7

FOLDING KNIFE WITH SAFETY LOCKING FEATURE

TECHNICAL FIELD

This invention pertains to folding knives, and more particularly to folding knives incorporating a safety feature for releasably securing the knife in the open or closed position.

BACKGROUND ART

Folding knives of the type wherein the blade is pivotable between an open position wherein the cutting edge of the blade is exposed and a closed position wherein the cutting edge of the blade is received in a recess in the handle are well known. Also well known are various safety features for securing the blade against accidental opening or closing for preventing injury.

One such arrangement is disclosed in U.S. Pat. No. 4,240,201 issued to Sawby et al. In Sawby, the top of the blade receiving recess is defined by a bar spring secured at its rear end such that the front end is free for limited upward movement. A projection at the front end of the bar spring seats in a complementary notch in the blade tang for positively securing the blade in its open position. To pivot the blade from the open to the closed position, Sawby provides a push button mechanism extending through the handle and into the recess, the mechanism having a camming surface which mates with a corresponding camming surface on the bar spring whereby depression of the push button cams the bar spring upward thereby unseating the projection from the notch whereupon the blade may be moved to its closed position. In the closed position, the front end of the bar spring abuts a surface of the tang opposite the notch. However, there is no positive engagement between the bar spring and the tang in this position. Consequently, the knife may be moved from the closed position to the open position without depressing the push button as rotation of the blade will inherently urge the bar spring upward to accommodate such movement.

In addition to the absence of any positive locking of the blade in the closed position, which is desirable as where the blade is unintentionally acquired by a child, the cooperation of the projection on the bar spring and the notch in the blade tang for securing the blade in the open position is subject to failure as the parts wear over a period of time.

DISCLOSURE OF THE INVENTION

The foldable knife in accordance with the present invention includes means for positively securing the knife both in the open and closed positions by means of a mechanism which substantially reduces, if not altogether eliminates, the possibility of malfunction due to wear.

In a basic embodiment, the foldable knife of the present invention comprises a handle having a longitudinal recess and an opening perpendicular to the recess and communicating therewith, a blade having a cutting edge at the front end and a tang at the rear end, means for securing the blade to the handle for pivotal movement between a closed position wherein the cutting edge is received in the recess and an open position wherein the cutting edge is exposed, a bar spring secured at one end to the handle in the recess, the free end of the bar spring being adjacent a first camming surface on the tang in the open position and a second camming surface on the tang in the closed position, the bar spring having a hole generally aligned with the opening in the handle, and a mechanism secured in the opening and extending through the hole, the mechanism having enlarged and reduced portions and means for moving the mechanism between a locking position in which the enlarged portion is in the hole for limiting movement of the bar spring under the urging of the first or second camming surfaces for blocking movement of the blade between the closed and open positions, and a release position wherein the reduced portion is in the hole and sufficient movement of the bar spring is accommodated under urging of the first or second camming surfaces for moving the blade between the closed and open positions.

Further features and advantages of the foldable knife in accordance with the present invention will be more fully apparent from the following detailed description and annexed drawings of presently preferred embodiments thereof.

BRIEF DESCRIPTION OF THE DRAWINGS

In the drawings, wherein like numerals represent like parts:

FIG. 1 is a side elevation, partly in phantom, of a first preferred knife in accordance with the present invention, the facing side of the handle being omitted for purposes of clarity;

FIG. 2 is a cross-sectional view taken substantially along the lines 2—2 in FIG. 1;

FIG. 3 is a cross-sectional view taken substantially along the lines 3—3 in FIG. 1;

FIG. 4 is a view similar to FIG. 1 showing the blade in an intermediate position;

FIG. 5 is a cross-sectional view taken substantially along the lines 5—5 in FIG. 4;

FIG. 6 is a cross-sectional view taken substantiall along the lines 6—6 in FIG. 4;

FIG. 7 is a fragmentary perspective view, partly exploded, of the preferred push button mechanism employed in the inventive knife of FIG. 1;

BEST MODE FOR CARRYING OUT THE INVENTION

Figure 8:
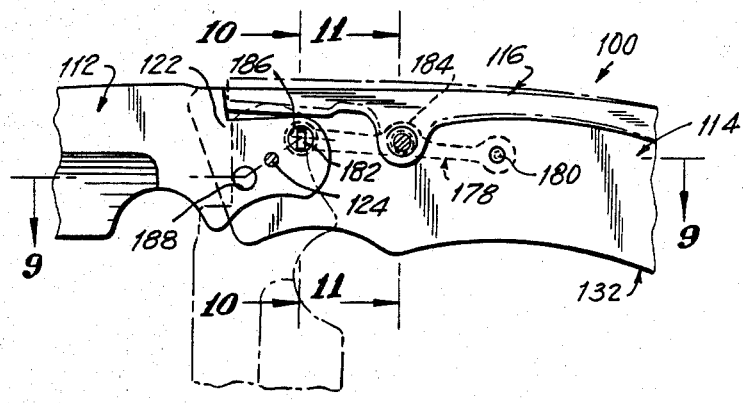
FIG. 8 is a side elevation, partly in phantom and partly broken away, of another form of the inventive folding knife incorporating a modified blade locking mechanism.
Figure 9:
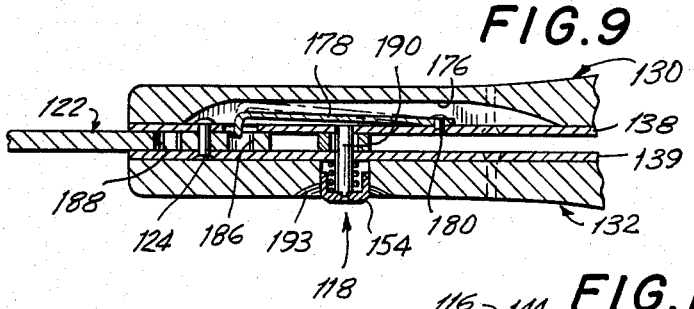
FIG. 9 is a cross-sectional view taken substantially along the lines 9—9 in FIG. 8.
Figure 10:
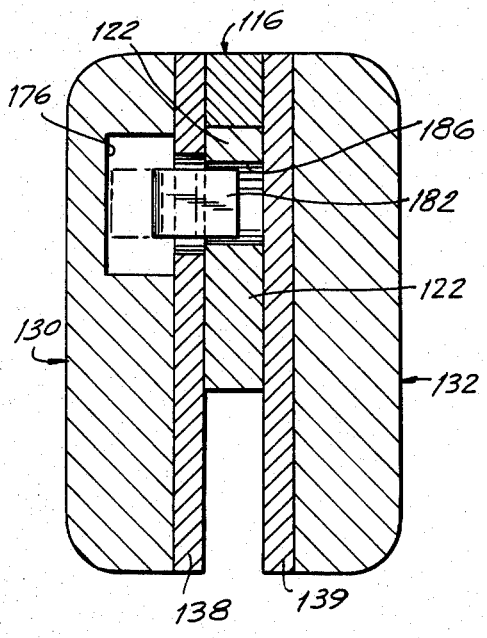
FIG. 10 is a cross-sectional view taken substantially along the lines 10—10 in FIG. 8.

Referring now to the drawings, and initially to FIGS. 1 and 4 thereof, a first preferred form of folding knife in accordance with the present invention is generally designated by the reference numeral 10. The principal components of the knife 10 are a blade 12, a handle 14, a bar spring 16, and a push button mechansim 18.

The blade 12 has a cutting edge 20 at the front end thereof and a tang 22 at the rear end, the tang having a generally centered hole 25 and first and second camming surfaces 26, 28. In accordance with conventional practice, the tang 22 may be thickened to provide added strength. The blade 12 is pivotally secured to the handle 14 by a transverse post 24 extending through the hole 25 and mounted in the handle 14 in a manner described below.

Referring to FIGS. 1, 3 and 4, handle 14 comprises two halves 30, 32 in confronting spaced relation for defining a longitudinally extending recess 34 therebetween for receiving the bar spring 16 and the cutting edge 20 of the blade 12 when the blade is in its closed position. As illustrated in FIG. 3, each half 30, 32 of the handle 14 is comprised of an outer part 36, 37, and an inner plate 38, 39, respectively. In acordance with conventional practice, the outer parts 36, 37 are secured to their respective inner plates 38, 39 as by gluing and riveting (not shown). As best shown in FIGS. 1 and 4, the two halves 30, 32 of handle 14 are secured together by rivets 40. The outer surfaces of the handle 14 are preferably rounded to facilitate handling.

The bar spring 16 seats in the upper part of the recess 34 in the handle 14. The bar spring extends substantially the full length of the handle 14 and has a depending section at its rear end which closes the back of the recess 34. Only the rear end of the bar spring is secured to the handle by rivets 40, whereby limited upward movement of the front end of the bar spring is accommodated. The front end of the bar spring 16 is provided with an enlargement 43 having a hole 44 therein. As best illustrated in FIGS. 1 and 4, and for reasons that will be explained hereinafter, the lower surface 42 of the bar spring 16 in front of the enlargement 43 abuts the camming surface 26 on tang 22 when blade 12 is in its open position (dotted lines in FIG. 1) and the edge or kick 29 of the tang 22 when the blade 12 is in its closed position (solid lines in FIG. 1).

As best shown in FIGS. 2 and 7, push button mechanism 18 comprises a bolt 46 having head 48 and a reduced diameter stem 50 threaded at its free end 52, an internally threaded push button 54 for receiving the threaded end 52 of the stem 50, and a coil spring 56 which seats about the stem 50.

Referring to FIGS. 2, 5 and 7, aligned transverse holes 58, 60 communicating with recess 34 are provided in handle parts 30, 32 respectively, for receiving push button mechanism 18. As shown, the hole 58 is closed at the end farthest from recess 34 whereas the hole 60 is open ended and includes a reduced diameter portion 62 in the plate 39. As shown, the holes 58 and 60 are also in alignment with the hole 44 in the bar spring 16. The holes 44 and 58 are dimensioned to receive with clearance the head 48 of the bolt 46. The enlarged part of the hole 60 is dimensioned to receive with clearance the push button 54. The reduced portion 62 of the hole 60 is dimensioned to receive with clearance the stem 50 of the bolt 46, but is smaller in diameter than the head 48.

As best illustrated in FIG. 2, when the push button mechanism 18 is in its rest or undepressed position, the head 48 of the bolt 46 is at least partially received in the hole 44 in the bar spring 16. As will be described more fully below in connection with the operation of the knife 10, this defines the safety or locking position. Referring to FIG. 5, when the mechanism 18 is depressed by applying pressure on the push button 54 (arrow 64 in FIG. 5), the head 48 is moved out of the hole 44 into the hole 58 in the handle part 30. In this position, only the stem 50 of the bolt 46 is in the hole 44 and the bar spring 16 is free for limited upward movement as indicted by the arrow 66 in FIG. 5.

To assemble the knife 10, the handle parts 30, 32 are first assembled by securing plates 38, 39 to outer parts 36, 37, respectively, as by rivets (not shown) or any other suitable means well known in the art. The head 48 of the bolt 46 is then seated in the hole 58 in the handle part 30 and one end of the post 24 is seated in the hole 68 in the plate 38. The hole 25 in the tang 22 of the blade 12 and the hole 44 in the bar spring 16 are then fitted over the post 24 and stem 50, respectively. The other half 32 of the handle 14 is then positioned such that the hole 60 fits over the stem 50 and the hole 70 in the plate 39 fits over the other end of the post 24. These parts are then secured in assembled relation by rivets 40. Assembly is completed by disposing coil spring 56 about the stem 50 and then threading push button 54 onto the stem 50. As best shown in FIGS. 1 and 5, when thus assembled one end of the coil spring 56 seats against plate 39 and the other end seats against an annular flange 72 in the push button 54 for biasing the mechanism 18 to its rest or undepressed position illustrated in FIG. 2. While a particular order of assembly for knife 10 has been described, those skilled in the art having read this description will appreciate that the precise order of steps described above is not essential.

To describe the manner of use, it will be assumed that the knife 10 is initially in the open position illustrated by the dotted lines in FIG. 1. In this position, the push button mechanism 18 is in the locking position illustrated in FIG. 2 wherein the head 48 of the bolt 46 is in the hole 44 in the bar spring 16, the mechanism 18 being retained in this position by the biasing effect of the coil spring 56. It will be apparent from FIG. 2 that in the locking position the head 48 of the bolt 46 substantially fully occupies the hole 44 in the bar spring 16 thereby precluding upward movement of the bar spring, upward movement of the bolt 46 being precluded by the close fit between the stem 50 and the reduced portion 62 of the hole 60.

As best shown in FIG. 1, when the knife is in the open position, the surface 42 at the front end of the bar spring 16 seats against the first camming surface 26 on the blade tang 22. In this position, it is impossible for the blade 12 to be rotated toward the closed position unless the front end of the bar spring 16 moves upwardly to accommodte rotation of the rear end of the tang 22. Since such upward movement is blocked when the push button mechanism 18 is in the locking position (FIG. 2), it will be apparent that as long as the mechansim 18 is in the locking position the blade 12 is secured in its open position.

To close the blade 12, the user presses on the push button 54, as with the thumb of the hand disposed about the handle 14, inward movement of the push button 54 being accommodated by the coil spring 56 (FIG. 5). When the button 54 is fully depressed the head 48 is moved entirely out of the hole 44 in the bar spring 16 and into the hole 58 in the handle part 30. At this point only the stem 50 is in the hole 44, the clearance resulting from the difference in diameter between the hole 44 and the stem 50 allowing limited upward movement of the bar spring 16. Thus, and as best shown in FIGS. 4 and 5, if the user now applies pressure to the top of the blade 12 for pivoting the blade toward the recess 34, rotation of the tang 22 is accommodated by upward movement of the bar spring 16 under the urging of the camming surface 26. The blade 12 is pivoted until its cutting edge 20 is received in the recess 34 (solid lines in FIG. 1) at which point the second camming surface 28 is in confronting relation with the surface 42 on the bar spring 16. The final position of the blade 12 in the recess 34 is defined by the abutment between the surface 42 of the bar spring 16 and the edge or kick 29 of the blade tang 22. It will be apparent from FIG. 1 that in this position the cutting edge 20 of the blade 12 is retained in spaced relation from the bar spring 16 to prevent the cutting edge 20 from becoming dulled with repeated closings.

When the blade 12 is in its fully closed position, the bar spring 16, which is secured at its rear end by the rivets 40, is now free to return to its rest position wherein the hole 44 is aligned with the hole 58 and the surface 42 abuts the second camming surface 28. If the user now releases the button 54, the coil spring 56 urges the button 54 outward which simultaneously moves the head 48 of the bolt 46 back into the hole 44 whereupon the mechanism 18 is returned to the locking position and upward movement of the bar spring is again blocked. Because the second camming surface 28 is in abutment with the surface 42 of the bar spring 16 when the knife is in the closed position, it will be apparent that rotation of the blade 12 from the closed position to the open position requires upward movement of the bar spring 16 to accommodate rotation of blade tang 22. Consequently, as long as the mechanism 18 is retained in the locking position, the blade 12 will be securely held in the closed position. To move the blade 12 from the closed position to the open position it will again be necessary to depress the button 54 of the mechanism 18 for moving the head 48 out of the hole 44 whereupon upward movement of the bar spring 16 will be accommodated under the urging of the second camming surface 28. Indents 76 of a type well known in the art may be provided near the upper edge of the blade 12 on either side thereof to facilitate gripping for movement to the open position.

Except for the outer parts 36, 37 of the handle 14, which may be comprised of wood, all the other parts of the knife 10 are preferably comprised of stainless steel, although other materials such as brass, may be employed.

A second or alternate embodiment of a foldable knife constructed in accordance with the present invention is illustrated in relevant part in FIGS. 8–12. Those elements of this second embodiment corresponding to like elements disclosed in connection with the knife form of FIGS. 1–7 are designated in FIGS. 8–12 with like reference numerals in the "100" series. Inasmuch as only the mechanism for locking the blade in its open and closed positions differs in this second embodiment, the drawings illustrate only the modified and new portions of the folding knife and those structures not shown in FIGS. 8–12 should be understood as being otherwise identical to the corresponding portions of the embodiment of FIGS. 1–7. The following description should accordingly be read in conjunction with the foregoing disclosure of the embodiment of FIGS. 1 to 7.

Turning now specifically to FIGS. 8–12, the modified knife 100 includes a pair of handle halves 130 and 132 to which a pair of inner plates 138, 139 are respectively secured as by rivets or the like in accordance with the prior embodiment. Blade 112 is pivotally supported between inner plates 138, 139 and handle halves 130, 132 at blade tang 122 by transverse post 124. Bar spring 116 is secured between handle halves 130, 132 so as to bear at its free end against the first and second camming surfaces of blade tang 122 in its retracted storage and open extended positions of blade 112, respectively.

Handle half 130 includes a longitudinal cutout or cavity 176 defined along its interior surface and bounded opposite handle half 130 by inner plate 138. A resilient elongated spring member 178 is secured, as by a rivet 180 through a mounting hole 181 at one of its ends, to inner plate 138. Spring member 178 carries at its opposite end an integral transverse finger 182 and, at a point intermediate finger 182 and mounting hole 181, an arched enlargement or shoulder 184. Blade tang 122 incorporates first and second locking openings or keyways 186, 188 disposed at diametrically opposite positions across transverse post 124 and sized to receive therein spring member finger 182 for positionally locking the knife blade 112 as will hereinafter be described.

Figure 11:
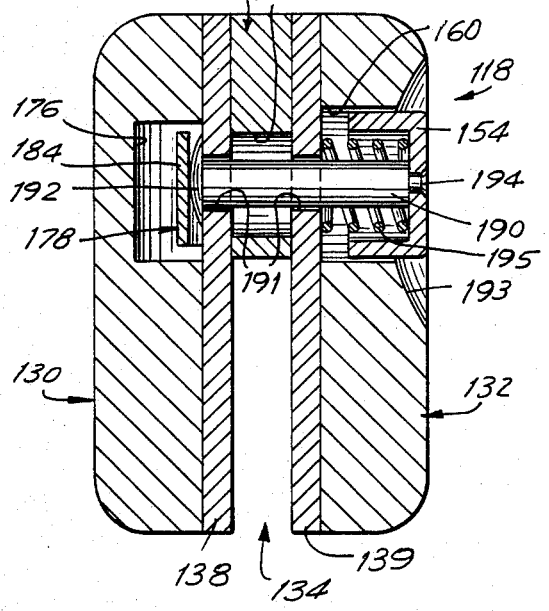
FIG. 11 is a cross-sectional view taken substantially along the lines 11—11 in FIG. 8.
Figure 12:
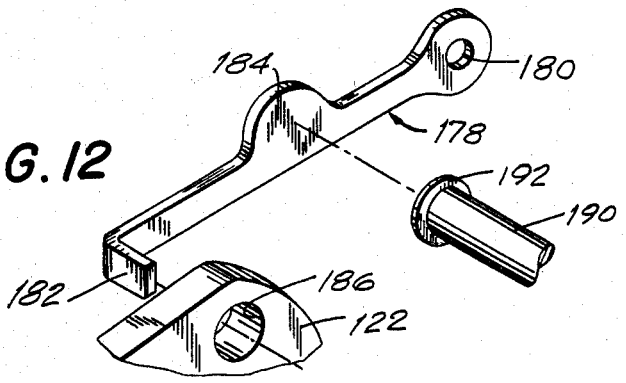
FIG. 12 is a fragmentary exploded perspective view of a portion of the modified blade locking mechanism of the folding knife embodiment shown in FIGS. 8–11.

A pushbutton mechanism 118 in handle 114 includes a bolt 190 slidably journalled through correspondingly sized passages 191 in inner plates 138, 139 and having an enlarged head 192 received in cutout 176 of handle part 130. As seen in FIG. 11, bolt head 192 abuts shoulder 184 of resilient spring member 178. In addition, the diameter of bolt 190 is sufficiently less than the cross-sectional size of bar spring hole 144 so that bar spring 116 is movable between its solid line to its dotted line positions seen in FIG. 8 and previously described in conjunction with the embodiment of FIGS. 1–7.

Handle part 132 includes a transverse hole 160 of enlarged diameter extending completely therethrough and joining a concavity or shallow recess 193 defined in the outer face of handle half 132. Transverse through-hole 160 slidably receives a pushbutton 154 secured, as by a threaded screw 194, to the end of bolt 190 opposite its head 192. A coil spring 195 encircles the portion of bolt 190 disposed in transverse hole 160 and is confined between inner plate 139 and an interior surface portion of pushbutton 154. The sizing and interengagement of the various elements of pushbutton mechanism 118 is such that the outer surface of pushbutton 154 is disposed, with bolt head 192 resting against inner plate 138, substantially along the plane of the corresponding outer surface or face of handle half 132. It should at this point be apparent that user-applied inward pressure to depress pushbutton 154, against the return urgency of coil spring 195, causes bolt 190 to be driven inward (leftward in FIG. 11), whereby the abutment of bolt head 192 against resilient spring member shoulder 184 causes corresponding transverse movement of the free end of spring member 178 and, in particular, of its transverse finger 182. Upon release of pushbutton 154 by the removal of finger pressure thereto, the return urgency of coil spring 195 causes bolt 190 to return rightward in FIG. 11; the resilience of spring member 178 causes it to likewise return along its elongation to its undeformed, substantially flat condition lying along and substantially parallel to inner plate 138 to which it is secured at rivet 180.

In operation, transverse finger 182 of spring member 178 is received in blade tang keyways 186 and 188 to positionally lock the knife blade in its open and closed positions, respectively. Thus, with the blade open or extended from handle 114, finger 182 is engages first keyway 186 whereby further pivotal movement of the blade about post 124 is prevented. Likewise, second keyway 188 of blade tang 122 receives the spring member finger 182 in the closed or retracted position of the knife blade to prevent unintended release and extension thereof. In each case, the deformable resilience of spring member 178 maintains the same in the substantially planar condition shown in FIG. 9 wherein member 178 lies in substantial abutment along the adjacent surface of inner plate 138 to which it is secured at rivet 180.

Those skilled in the art should now recognize the manner in which this second or modified embodiment of the inventive folding knife is operable for retraction and extension of blade 112. User application of inwardly-directed pressure to pushbutton 154, so as to depress the same, causes bolt head 192 to carry the unsecured portion of spring member 178 out of substantial abutment or parallelism with inner plate 138 (leftward in FIG. 11). As spring member 178 resiliently deforms with user depression of pushbutton 154, finger 182 is carried clear and sufficiently remote from the blade and the locking keyway 186 or 188 within which it had been disposed to maintain the then current blade position. With pushbuttom 154 fully depressed to the extent permitted by the depth of concavity 193 and the legs of pushbutton 154, and finger 182 thereby maintained out of engagement with the tang keyway, blade 112 may be readily manipulated by the user to pivotally carry it from its open to its closed position, or vice versa, as appropriate. User release of pushbutton 154, when the blade has attained its new position, enables the resilient return of spring member 178 to its initial, unstressed condition wherein transverse finger 182 is received engagingly in the now aligned locking keyway 186 (for an open blade) or 188 (for a closed or retracted blade).

It should further be understood that, in this modified embodiment of the invention, bar spring 116 provides a camming function with respect to blade tang 122 which corresponds to that provided by bar spring 16 in the first-disclosed form of foldable knife 10. The enlarged diameter of hole 144, with respect to the smaller cross section of bolt 190, enables the camming movement of bar spring 116 appropriate for permitting pivotal manipulation of blade 112 when pushbutton 154 is depressed within handle concavity 193.

While preferred embodiments of a folding knife in accordance with the present invention have been shown and described, those skilled in the art will appreciate that numerous changes and modifications may be made therein without departing from the spirit and scope of the invention. For example, while the holes in the handles 14 and 114 and bar spring 16 and 116 are preferably of circular cross section, this is not mandatory. Since this as well as further changes and additions are intended to be within the scope of the present invention, the above description should be construed as illustrative, and not in a limiting sense, the scope of the invention being defined by the following claims.

We claim:

1. A foldable knife comprising:

a handle having a longitudinal recess and an opening perpendicular to said recess and communicating therewith, said opening being open-ended on one side of the handle;

a blade having a cutting edge at the front end and a tang at the rear end, said tang having first and second camming surfaces;

means for securing said blade to said handle for pivotal movement between a closed position wherein the cutting edge is received in the recess and an open position wherein the cutting edge is exposed;

a bar spring secured at one end to the handle in the recess, the free end of the bar spring being adjacent the first camming surface in the open position and the second camming surface in the closed position, said bar spring having a hole therein generally aligned with said opening in said handle;

a mechanism secured in said opening and extending through said hole, said mechanism comprising an enlarged portion and a reduced portion, means for moving said mechanism between a locking position wherein said enlarged portion is in said hole for limiting movement of said bar spring under the urging of said first or second camming surfaces for preventing movement of the blade to the closed or open positions respectively, and a release position wherein said reduced portion is in said hole and sufficient movement of said bar spring is accommodated under urging of said first or second camming surfaces for moving said blade to said closed or open positions, respectively; and means for biasing said mechanism to said locking position;

wherein said mechanism moving means comprises a push button secured to the end of said reduced portion opposite said enlarged portion, said push button being accessible through said open end of said opening, and wherein the open-ended side of said opening includes an enlarged section and a reduced section, said reduced section being dimensioned to receive said reduced portion of said mechanism but not said enlarged portion, wherein said biasing means comprises a coil spring disposed about said reduced portion and seating at one end on a shoulder defined between said enlarged and reduced sections of said opening and at the other end against said push button, and wherein the opening in said handle is close-ended on the other side thereof.

2. The foldable knife according to claim 1, further comprising a boss on said bar spring and a recess on said tang, said boss seating in said recess for defining the closed position of said blade, said cutting edge being maintained in spaced relation from said bar spring in said closed position.

3. A foldable knife comprising:

a handle having a longitudinal recess and an opening perpendicular to said recess and communicating therewith;

a blade having a cutting edge at the front end and a tang at the rear end, said tang having first and second camming surfaces, and said blade including a pair of keyways defined therein;

means for securing said blade to said handle for pivotal movement between a closed position wherein the cutting edge is received in the recess and an open position wherein the cutting edge is exposed;

a resilient elongated spring member secured at one end within said handle and carrying a transverse finger at its opposite end for receipt in one of said keyways to lock the blade in said closed position and for receipt in the other of said keyways to lock the blade in said open position;

a bar spring secured at one end to the handle in the recess, the free end of the bar spring being adjacent the first camming surface in the open position and the second camming surface in the closed position, said bar spring having a hole therein generally aligned with said opening in said handle; and a mechanism secured in said opening and extending through said hole, said mechanism comprising a slidable means disposed in abutment with said spring member, means for moving said mechanism between a blade locking position wherein said finger is disposed in one of said keyways for preventing pivotal movement of said blade between its closed and open positions, and a release position wherein said spring member is resiliently deformed to carry said finger to a position sufficiently remote from said blade keyways to permit pivotal movement of the blade between its closed and open positions;

said spring member including a shoulder substantially intermediate its opposite ends for abutment with said slidable means.

4. The foldable knife in accordance with claim 3, further comprising means for biasing said mechanism to said locking position.

5. The foldable knife in accordance with claim 4, said biasing means comprising a coil spring disposed about said slidable means.

6. The foldable knife in accordance with claim 4, said moving means comprising a user-operable pushbutton secured to said slidable means.

7. The foldable knife in accordance with claim 3, further comprising a cutout in said handle within which said spring member is disposed for transverse movement in response to movement of said mechanism between said blade locking and release positions.

8. The foldable knife in accordance with claim 3, said blade keyways being defined in said tang.

9. The foldable knife in accordance with claim 8, said keyways being disposed substantially adjacent to and diametrically about the pivotal securement of said blade to said handle.

10. A foldable knife comprising:

a handle having a longitudinal recess and an opening perpendicular to said recess and communicating therewith;

a blade having a cutting edge at the front end and a tang at the rear end, said tang having first and second camming surfaces, and said blade including a pair of keyways defined therein;

means for securing said blade to said handle for pivotal movement between a closed position wherein the cutting edge is received in the recess and an open position wherein the cutting edge is exposed;

a resilient elongated spring member secured at one end within said handle and carrying a transverse finger at its opposite end for receipt in one of said keyways to lock the blade in said closed position and for receipt in the other of said keyways to lock the blade in said open position;

a bar spring secured at one end to the handle in the recess, the free end of the bar spring being adjacent the first camming surface in the open position and the second camming surface in the closed position, said bar spring having a hole therein generally aligned with said opening in said handle; and a mechanism secured in said opening and extending through said hole, said mechanism comprising a slidable means disposed in abutment with said spring member, means for moving said mechanism between a blade locking position wherein said finger is disposed in one of said keyways for preventing pivotal movement of said blade between its closed and open positions, and a release position wherein said spring member is resiliently deformed to carry said finger to a position sufficiently remote from said blade keyways to permit pivotal movement of the blade between its closed and open positions;

said slidable means having an enlarged portion and a reduced portion, said reduced portion being disposed in said bar spring hole and having a diameter sufficiently smaller than the diameter of said hole for accommodating limited movement of said bar spring under the urgency of said blade tang in moving said blade between its closed and open positions.

11. The foldable knife in accordance with claim 10, further comprising means for biasing said mechanism to said locking position.

12. The foldable knife in accordance with claim 11, said biasing means comprising a coil spring disposed about said slidable means.

13. The foldable knife in accordance with claim 11, said moving means comprising a user-operable pushbutton secured to said slidable means.

14. The foldable knife in accordance with claim 10, further comprising a cutout in said handle within which said spring member is disposed for transverse movement in response to movement of said mechanism between said blade locking and release positions.

15. The foldable knife in accordance with claim 10, said blade keyways being defined in said tang.

16. The foldable knife in accordance with claim 15, said keyways being disposed substantially adjacent to and diametrically about the pivotal securement of said blade to said handle.

* * * * *